US011433926B2

(12) United States Patent
Zaytun et al.

(10) Patent No.: US 11,433,926 B2
(45) Date of Patent: Sep. 6, 2022

(54) TRAVELLING APPARATUS

(71) Applicants: Daniel Zaytun, Bet-She'an (IL); Aviel Zaytun, Bet-She'an (IL)

(72) Inventors: Daniel Zaytun, Bet-She'an (IL); Aviel Zaytun, Bet-She'an (IL)

( * ) Notice: Subject to any disclaimer, the term of this patent is extended or adjusted under 35 U.S.C. 154(b) by 418 days.

(21) Appl. No.: 16/435,705

(22) Filed: Jun. 10, 2019

(65) Prior Publication Data

US 2020/0239035 A1 Jul. 30, 2020

Related U.S. Application Data

(60) Provisional application No. 62/798,483, filed on Jan. 30, 2019.

(51) Int. Cl.
*B61B 13/00* (2006.01)
*B61C 3/00* (2006.01)

(52) U.S. Cl.
CPC ..... *B61B 13/00* (2013.01); *B61C 3/00* (2013.01)

(58) Field of Classification Search
CPC .. B61B 13/00; B61C 3/00; A63G 7/00; A63G 21/00; A63G 21/04
See application file for complete search history.

(56) References Cited

U.S. PATENT DOCUMENTS 7,935,032 B1 * 5/2011 Jackson ..... A63B 69/0093 482/70
2010/0039285 A1 2/2010 Vornbrock
2018/0039285 A1 * 2/2018 Giegel ..... B65B 17/02

* cited by examiner

*Primary Examiner* — Robert J McGarry, Jr.
(74) *Attorney, Agent, or Firm* — Alphapatent Associates, Ltd; Daniel J. Swirsky

(57) ABSTRACT

A travelling apparatus, including: a rail; at least one vehicle, for travelling in a direction being along the rail; and a holding structure, for holding a user to stand on the at least one vehicle, with one foot in front of another along the travelling direction, thereby forces produced by the travelling, are applied on one side of the user in relation to the other, thus being safe to the user, thereby diminishing width of the rail.

9 Claims, 5 Drawing Sheets

TRAVELLING APPARATUS

CROSS-REFERENCE TO RELATED APPLICATIONS

This application claims the benefit of priority from U.S. Provisional Application No. 62/798,483, filed Jan. 30, 2019, the disclosure of which is incorporated herein by reference.

TECHNICAL FIELD

The invention relates to the field of user's travelling, for fun or for practical goals.

BACKGROUND

Conventional vehicles must include significant means for providing safety to the user. Thus, for example motorized scooters are limited by law to a very low speed.

There is a long felt need to provide a solution to the above-mentioned and other problems of the prior art.

SUMMARY

A travelling apparatus, including:
a rail;
at least one vehicle, for travelling along the rail; and
a holding structure.

BRIEF DESCRIPTION OF THE DRAWINGS

Embodiments, features, and aspects of the invention are described herein in conjunction with the following drawings.

The drawings are not necessarily drawn to scale.

DETAILED DESCRIPTION

The invention will be understood from the following detailed description of embodiments of the invention, which are meant to be descriptive and not limiting. For the sake of brevity, some well-known features are not described in detail.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

Figure 1:
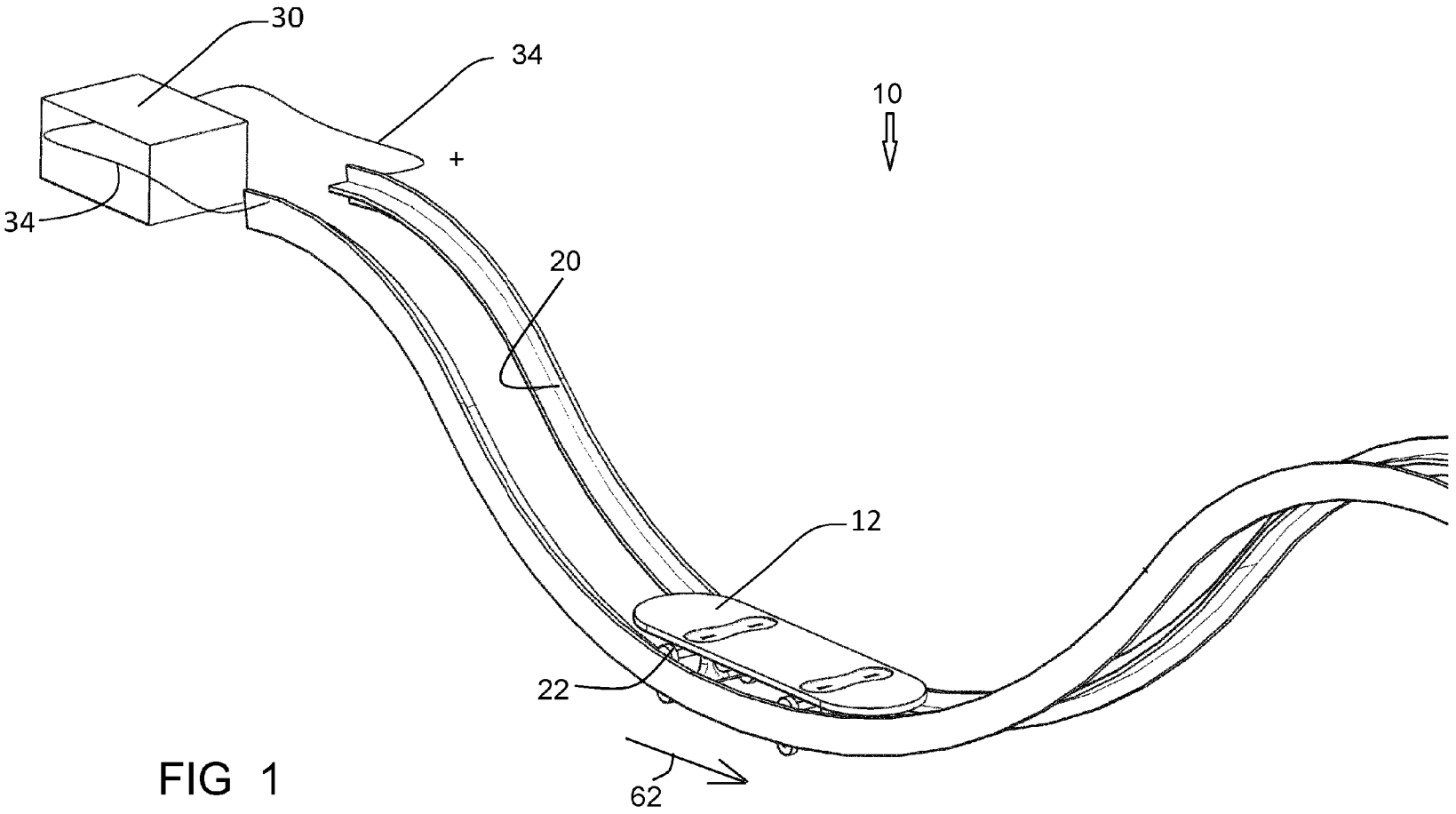
FIG. 1 is a front perspective view of a travelling apparatus according to one embodiment of the invention.

FIG. 1 is a front perspective view of a travelling apparatus according to one embodiment of the invention.

A travelling apparatus 10 includes a rail 20; at least one vehicle 12 including an electric motor 22, for travelling along 62 rail 20; and an electric source 30, for energizing motor 22 through rail 20.

Figure 2:
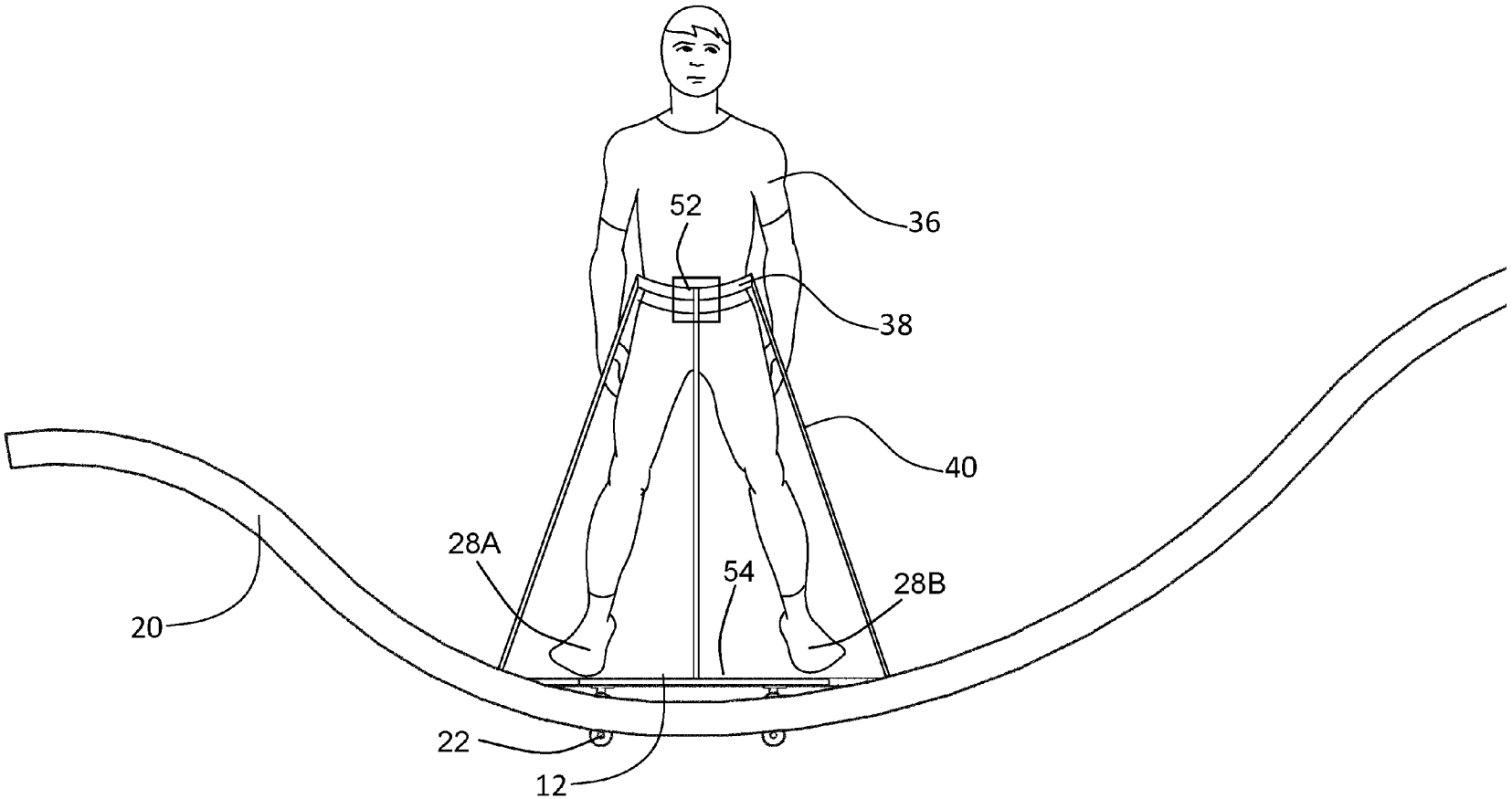
FIG. 2 is a front view of a user riding by the travelling apparatus of FIG. 1.

FIG. 2 is a front view of a user riding by the travelling apparatus of FIG. 1.

Rail 12 includes a user interface 52, for operating motor 22.

Vehicle 12 is intended for standing thereon, and includes several safety elements as described following.

Figure 3:
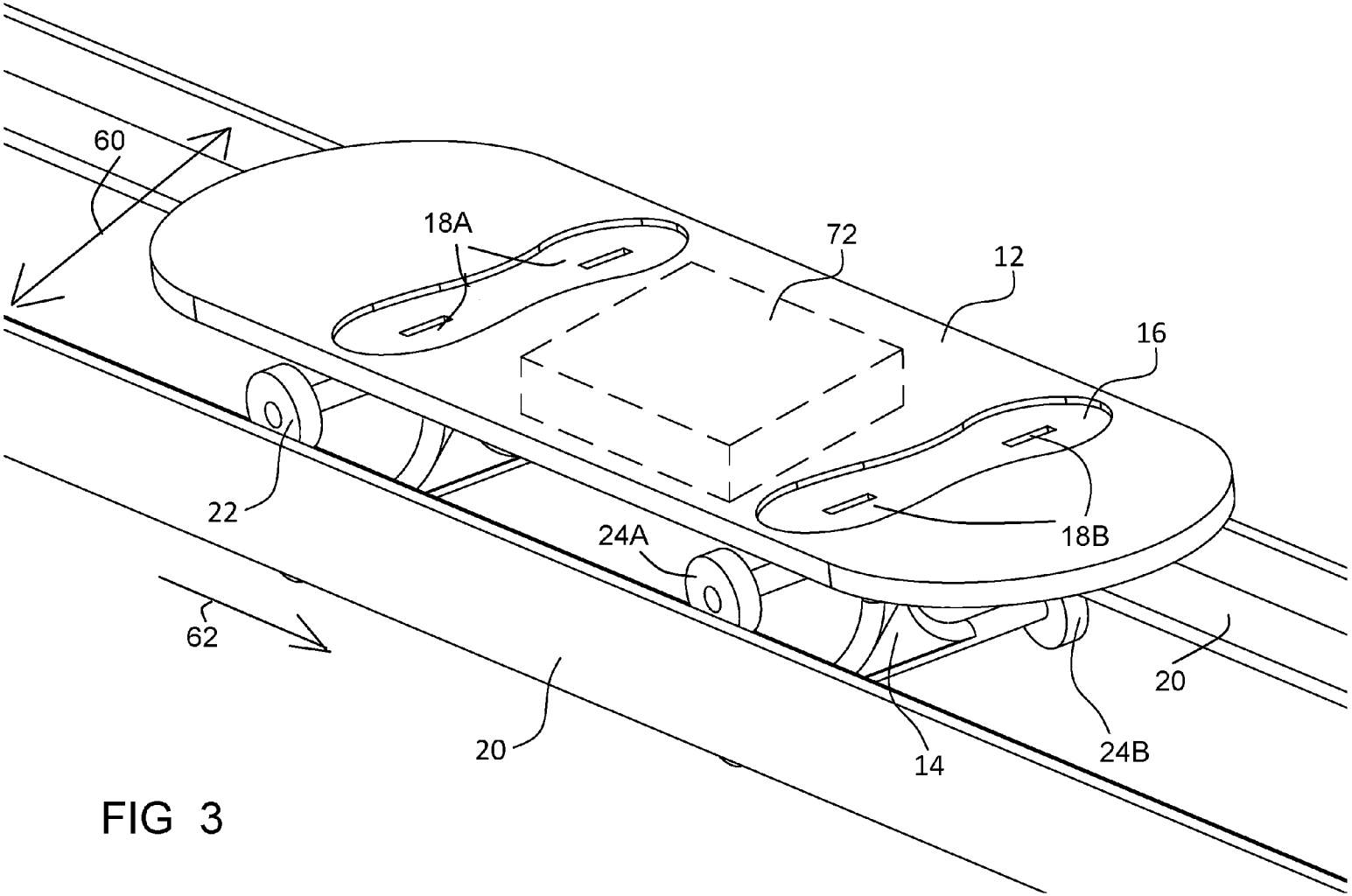
FIG. 3 is a front perspective view of the vehicle of FIG. 1.

FIG. 3 is a front perspective view of the vehicle of FIG. 1.

Figure 4:
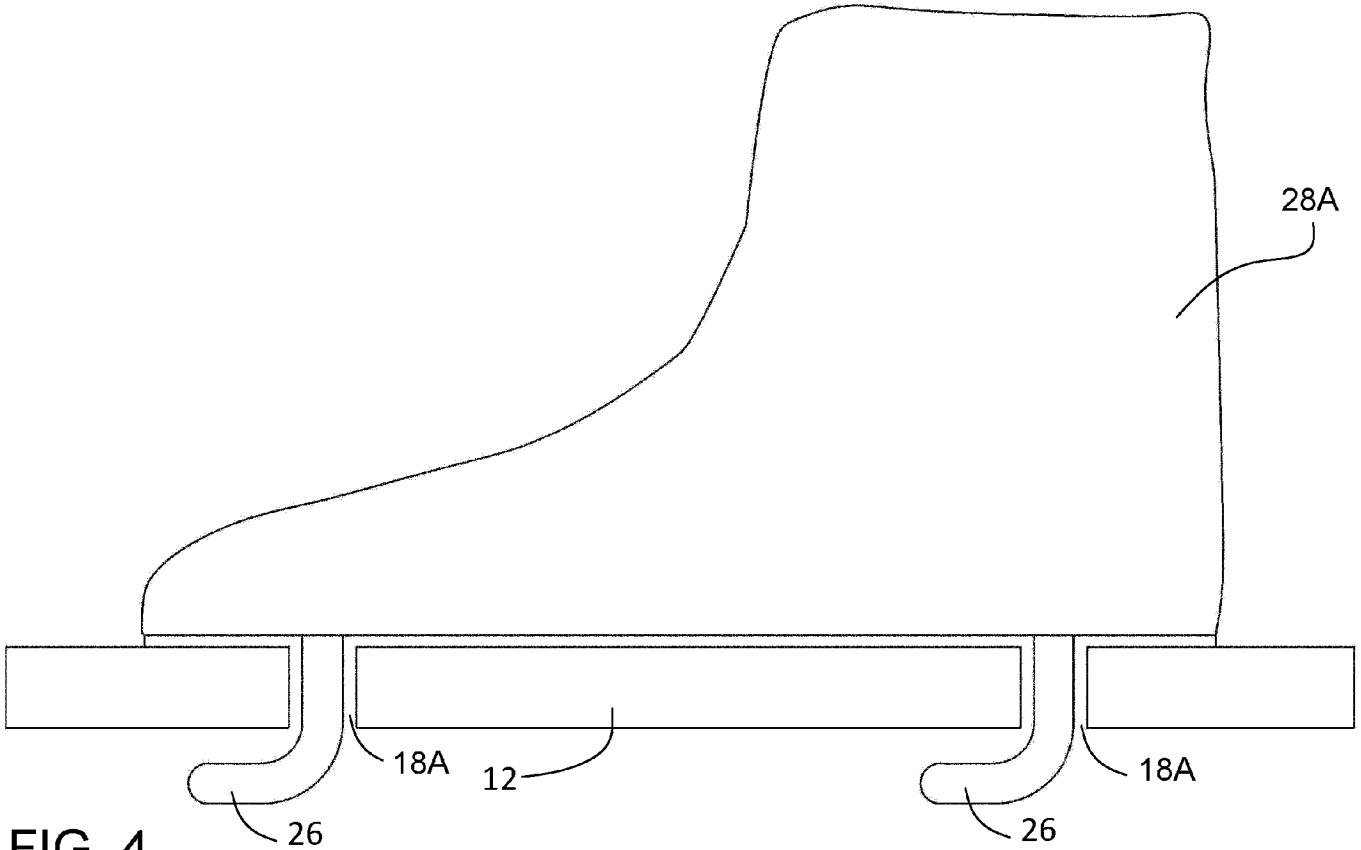
FIG. 4 is a side view of the vehicle of FIG. 3.

The first safety element are wheels 24A disposed above rail 20 and wheels 24B disposed below rail 20, thus securing and avoiding removing vehicle 12 from rail 20. Thus, rail 20 may be curved, even to hang the user up-side-down FIG. 4 is a side view of the vehicle of FIG. 3.

Vehicle 12 further includes fasteners 18, for fastening shoes 28A, depicted in FIG. 2.

Figure 5:
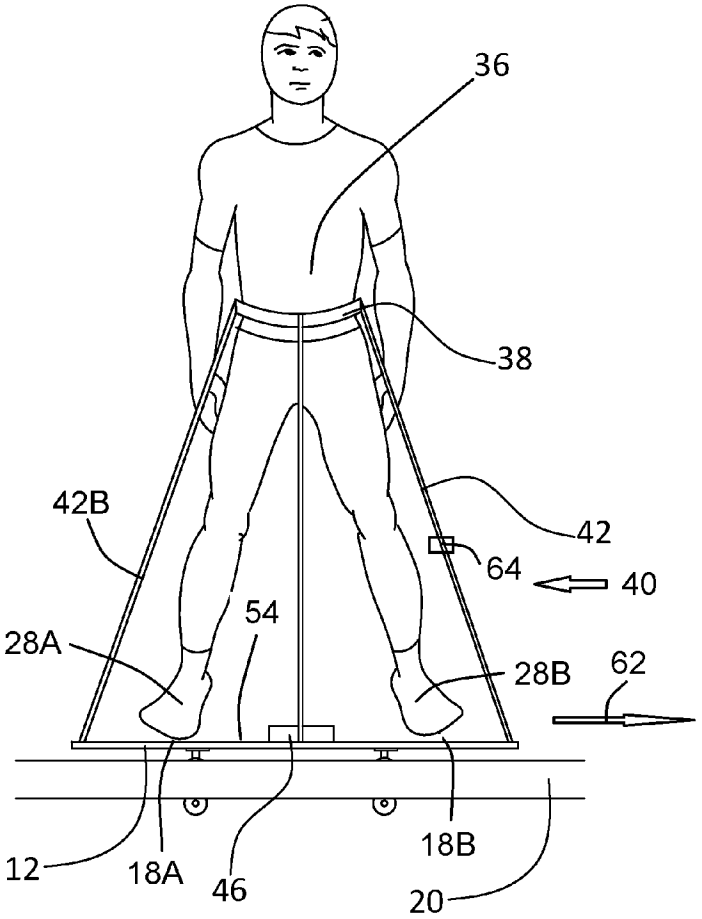
FIG. 5 depicts additional safety elements.

FIG. 5 depicts additional safety elements.

Fasteners 18A and 18B are disposed on vehicle 12 along 62 rail 20, thus positioning the user feet along rail 20. This positioning is advantaged for requiring a narrow rail 20, being the width (front to back) of the person rather than being the length (hand to hand) thereof.

Further, the forces produced by the travelling on the user, are applied on the sides, right and left, of the user, onto which the user can reject, rather than on front and back.

A holding structure 40, extending from the floor 54 of vehicle 12 upwards to the user's chest, constitutes an additional safety element.

Holding structure 40 may include rods at the side, rear and front of the user, which may be extendable.

A motion sensor 46 may control the extension of the rods, as a function of the travelling and of the user, for cancelling acceleration and deceleration thereof.

Figure 6:
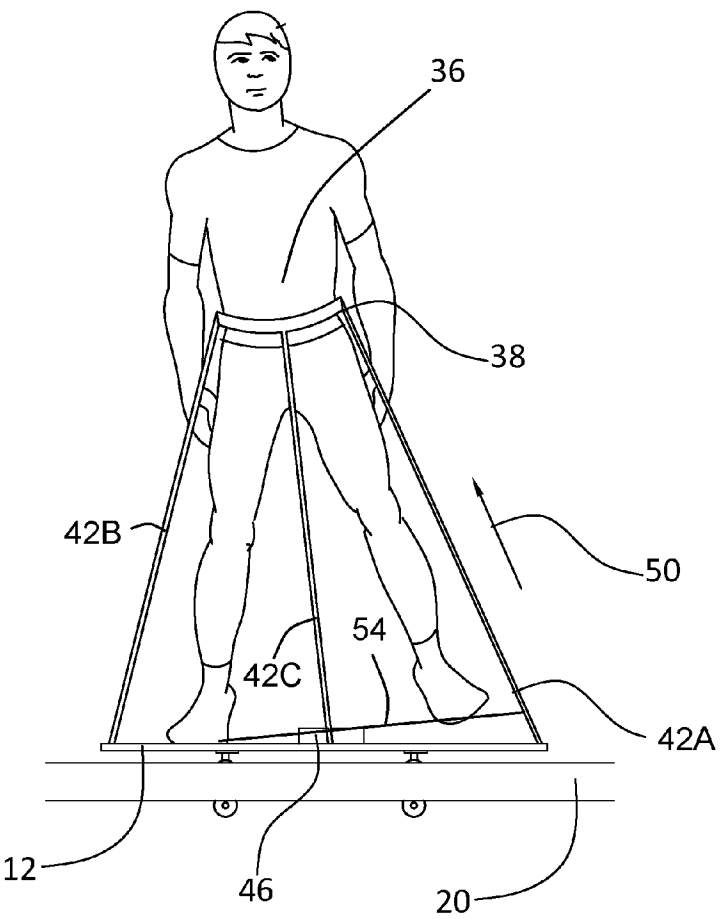
FIG. 6 depicts an example of automated extending of the telescopic rod of FIG. 5.

FIG. 6 depicts an example of automated extending of the telescopic rod of FIG. 5.

For example, the right rod 42A may be extended by a motor 64, in relation to the left rod 42B for tilting holding structure 40, for tilting the user's body to the left once motion sensor 46 senses acceleration of vehicle 12, disposed at the bottom of the user, to the left.

Holding structure 40 further includes platform 54, being tilted together with rod 12A.

Front rod 42C and the rear rod (hidden) may also be extendable for protecting the user from forward and backward motions of the vehicle and/or self motions, as sensed by motion sensor 46.

Thus, in one aspect, the invention is directed to a travelling apparatus (10), including:

a rail (20);

at least one vehicle (12), for travelling in a direction being along the rail (20); and a holding structure (40), for holding a user to stand on the at least one vehicle (12), with one foot in front of another along the travelling direction, thereby forces produced by the travelling, are applied on one side of the user in relation to the other, thus being safe to the user, thereby diminishing width (60) of the rail (20).

The holding structure (40) may include two fasteners (18A,18B) disposed on the at least one vehicle (12) along the rail (20), each for fastening one shoe (28A) of the user.

The holding structure (40) may include two rods (42A, 42B), disposed at the sides of the user, for tilting the user to cancel the side forces produced by the travelling.

The holding structure (40) may extend from the bottom of the vehicle (12) up to the user's body.

The holding structure (40) may be motorazably (64) tiltable, for allowing motorized tilting of the user.

The travelling apparatus may further include a motion sensor (46), for controlling the motorized tilting of the holding structure (40) to cancel acceleration of the at least one vehicle (20).

The holding structure (40) may include the floor (54) on which the user stands, being tiltable.

The vehicle (12) may include an electric motor (22), for being energized by the electric connection of the rail (20).

The vehicle (12) may includes wheels (24A) disposed above the rail (20) and wheels (24B) disposed below the rail (20), thus securing the vehicle (12) to the rail (20), thereby allowing curving the rail (20) up and down.

In the figures and/or description herein, the following reference numerals (Reference Signs List) have been mentioned:

numeral 10 denotes the travelling apparatus according to one embodiment of the invention;

14: axle;

18A,18B: fastener for user's shoe;

20: rail;

22: electric motor;

24A: top wheel;

24B: bottom wheel;

26: male member of fastener;

28A,28B: shoes worn by the user;

34: electric wire;

36: user's body;

38: top holding of holding structure 40 to the user's body;

40: holding structure;

42A,42B,42C: telescopic rods;

46: motion sensor;

50: extending of telescopic rod 42A;

52: user interface;

54: vehicle's floor/platform for supporting shoes 28A, 28B;

60: rail's width;

62: direction of travelling, being along rail 20;

64: motor for extending rod 42A;

72: electric circuit for operating motor 22.

The foregoing description and illustrations of the embodiments of the invention have been presented for the purpose of illustration, and are not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. A travelling apparatus, comprising:

a rail;

at least one vehicle comprising a plate and at least two axles fixed thereto each comprising wheels rotatable in relation said axles, for travelling said plate of said at least one vehicle via said wheels in a direction being along said rail, thereby said plate is non-rotatable in relation to said rail; and a holding structure fixed to said plate, for fastening a user's shoes to said plate in an orientation that is perpendicular to said traveling direction, thereby avoiding rotation of said user's shoes in relation to said rail.

2. The travelling apparatus according to claim 1, wherein said holding structure comprises two fasteners disposed on said plate along said rail, each for fastening one shoe of the user.

3. The travelling apparatus according to claim 1, wherein said holding structure comprises two rods, disposed at said sides of a body of the user, for tilting the user's body to cancel said side forces produced by said travelling.

4. The travelling apparatus according to claim 1, wherein said holding structure extends from said plate up to a body of said user.

5. The travelling apparatus according to claim 1, wherein said holding structure comprises a platform being motorizably tiltable in relation to said plate, for allowing motorized tilting of said user.

6. The travelling apparatus according to claim 5, further comprising a motion sensor, for controlling said motorized tilting of said platform to cancel acceleration of said at least one vehicle.

7. The travelling apparatus according to claim 1, wherein said at least one vehicle comprises an electric motor, for being energized by said electric connection of said rail.

8. The travelling apparatus according to claim 1, wherein said at least one vehicle comprises wheels disposed above said rail and wheels disposed below said rail, thus securing said at least one vehicle to said rail, thereby allowing curving said rail up and down.

9. The travelling apparatus according to claim 1, further comprising:

a top holding of a holding structure, for holding a body of the user;

a first rod extending from a front end of said plate upwards towards said top holding, thereby to a first side of said user's body; and a second rod extending from a rear end of said plate upwards towards said top holding, thereby to a second side of said user's body wherein a front end of said plate and a rear end of said plate relate to said direction being along said rail.

* * * * *